US006474893B1

(12) United States Patent
Osada et al.

(10) Patent No.: US 6,474,893 B1
(45) Date of Patent: Nov. 5, 2002

(54) WRITING INSTRUMENT HAVING EXCELLENT CAP-OFF PERFORMANCE

(75) Inventors: Takahiro Osada, Sawa-gun; Kazuhiro Ami, Tano-gun, both of (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/868,610

(22) PCT Filed: Dec. 17, 1999

(86) PCT No.: PCT/JP99/07097

§ 371 (c)(1),
(2), (4) Date: Jun. 18, 2001

(87) PCT Pub. No.: WO00/37265

PCT Pub. Date: Jun. 29, 2000

(30) Foreign Application Priority Data

Dec. 18, 1998 (JP) ..... 10-361095

(51) Int. Cl.[7] ..... B43K 5/00
(52) U.S. Cl. ..... 401/198; 401/196
(58) Field of Search ..... 401/196, 198, 401/199, 205, 221, 222, 231; 106/31.57, 31.85

(56) References Cited

U.S. PATENT DOCUMENTS 6,004,388 A * 12/1999 Osada ..... 106/31.57

FOREIGN PATENT DOCUMENTS

| | | | |
|---|---|---|---|
| JP | 5-6112980 | 9/1981 | ..... C09D/11/16 |
| JP | 58108270 | 6/1983 | ..... C09D/11/00 |
| JP | 61261380 | 11/1986 | ..... C09D/11/16 |
| JP | 62-9437 | 2/1987 | ..... B43K/1/12 |
| JP | 01263173 | 10/1989 | ..... C09D/11/16 |
| JP | 02232277 | 9/1990 | ..... C09D/11/16 |
| JP | 03097774 | 4/1991 | ..... C09D/11/02 |
| JP | 07-242094 | 9/1995 | ..... B43K/8/02 |
| JP | 10-060355 | 3/1998 | ..... C09D/11/16 |
| JP | 10-140071 | 5/1998 | ..... C09D/11/16 |

* cited by examiner

*Primary Examiner*—David J. Walczak
(74) *Attorney, Agent, or Firm*—Darby & Darby

(57) ABSTRACT

The writing instrument having an excellent cap-off performance is characterized, as shown in, for example, FIG. 3, by that in a writing instrument 10 having a pen tip 13 comprising a fibrous feed or a plastic feed, the pen tip 13 described above is coated with a substance which is solid at room temperature and in which a solubility in an ink solvent is 10% or less at room temperature among substances providing the pen tip with a cap-off property. This writing instrument 10 is such excellent in a cap-off performance that the good writing performance is obtained even after the pen tip is left standing in the air over a long period of time.

8 Claims, 9 Drawing Sheets

WRITING INSTRUMENT HAVING EXCELLENT CAP-OFF PERFORMANCE

TECHNICAL FIELD

The present invention relates to a writing instrument which has a good writing performance even after a pen tip is left standing in the air for a long period of time and which is excellent in a cap-off performance.

BACKGROUND ART

Writing instruments in which inks are penetrated into pen tips comprising a fibrous feed or a plastic feed so as to write, such as a marking pen, a sign pen and a brush pen have so far been used in many cases.

However, when a cap is taken away to leave a pen tip part standing in the air for long tome, there is involved the problem that the pen tip part is dried to cause inferior writing.

In the past, writing instruments such as a marking pen, a sign pen and a brush pen each having an excellent cap-off performance are obtained by adding to inks, additives such as higher fatty acid esters of specific polyglycerin, specific acidic phosphoric acid higher alcohol esters and salts thereof, specific phosphorous acid higher alcohol esters and specific decaglycerin stearic acid esters each of which makes it possible to inhibit vaporization (Japanese Patent Publication No. Sho 62-34352 and Japanese Patent Application Laid-Open No. Sho 61-261380).

However, a large part of additives having a high vaporization-inhibiting effect has a solubility of 10% by weight or less in solvents and has a problem in terms of a low solubility. In particular, the solubility at 0° C. is 5% by weight or less, and there are the problems that storage at a low temperature and repeating of low and high temperatures produce precipitations of the additives described above in the inks and bring about clogging in the ink passages to reduce the writing property or deteriorate the cap-off property with the passage of time.

On the other hand, disclosed in Japanese Patent Application Laid-Open No. Hei 7-242094 is a dry-preventing method for a writing instrument in which in order to effectively inhibit an ink solvent from volatilizing from a writing part in a period of time passing until first writing after producing the writing instrument to prevent inferior writing in a non-use state from being caused over a long period of time, one end part of a writing feed comprising a porous feed material is inserted into an ink reservoir absorbing an ink prepared by dissolving a dye in solvents and the other end is formed in a writing part of the writing instrument and in which a high boiling solvent such as benzyl alcohol having a slow volatilizing speed among the ink solvents is coated on or impregnated into the writing part of the writing feed described above.

However, the dry-preventing method disclosed in this gazette has an object to prevent drying in a period of time passing until first writing after producing the writing instrument, and a target thereof is a high boiling solvent such as benzyl alcohol having a slow volatilizing speed among the ink solvents, so that the writing part is not prevented from being dried after writing, and it is different from the present invention in terms of an object, an action and a structure (technical idea). Further, benzyl alcohol used for the dry-preventing method for a writing instrument described above is liquid at room temperature and freely miscible with solvents, and it has the problem that if it is left standing over a long period of time, it is introduced into the ink reservoir by diffusion of the solution and the effect is almost lost. Further, benzyl alcohol flows out by writing once, and therefore the effect is not continued to be shown until the ink is exhausted.

Accordingly, the existing state is that in writing instruments such as a marking pen, a sign pen and a brush pen each having a pen tip comprising a fibrous feed or a plastic feed, demanded are writing instruments which have a good preservability at a low temperature and in which a cap-off performance is not deteriorated with the passage of time and that desired are writing instruments which do not bring about starving in writing as well when the pen tip is left standing in the air over a long period of time by forgetting to put the cap and which provides an excellent writing performance.

In light of the problems on the conventional techniques described above, the present invention intends to solve them, and an object thereof is to provide a writing instrument which has a good preservability at a low temperature and does not cause clogging in an ink passage and which provides a good writing performance even after the pen tip is left standing in the air over a long period of time and is excellent in a cap-off performance.

DISCLOSURE OF THE INVENTION

Intensive investigations of the problems of the conventional techniques described above repeated by the present inventors have resulted in finding that in order to obtain writing instruments such as a marking pen, a sign pen and a brush pen each having an excellent cap-off performance, pen tips comprising a fibrous feed or a plastic feed which are used for these writing instruments are coated with an additive which is less liable to be dissolved in solvents and has a vaporization-inhibiting effect, whereby a writing instrument meeting the object described above can be obtained. Thus, they have come to complete the present invention.

That is, the writing instrument of the present invention having an excellent cap-off performance comprises the following items (1) to (8).

(1) A writing instrument having an excellent cap-off performance, wherein in the writing instrument having a pen tip comprising a fibrous feed or a plastic feed, the pen tip described above is coated with a substance which is solid at room temperature and in which a solubility in an ink solvent is 10% or less at room temperature and which repeatedly and constantly films on a surface part of the pen tip that can be broken by writing pressure in writing, among substances providing the pen tip with a cap-off property.

(2) The writing instrument having an excellent cap-off performance as described in the above item (1), wherein the coated substance has a melting point of 40 to 95° C.

(3) The writing instrument having an excellent cap-off performance as described in the above item (1) or (2), wherein the coating substance is at least one selected from glycerin derivatives, alkylphosphoric acid esters, polyoxyethylenesorbitan fatty acid esters, polyoxyethylenesorbit fatty acid esters, paraffin wax, microcrystalline wax, polyolefin wax, pentaerythritol derivatives and lecithin.

(4) The writing instrument having an excellent cap-off performance as described in any of the above items (1) to (3), wherein the amount coated on the pen tip is 0.01 to 20% by weight in terms of a weight ratio.

(5) The writing instrument having an excellent cap-off performance as described in any of the above items (1) to (4), wherein a substance which is solid at room temperature and in which a solubility in an ink solvent is 0.01 to 10% at room temperature among substances providing a cap-off property being added to an ink in the writing instrument and the adding amount of which is 0.01 to 10% by weight based on total amount of the ink.

(6) The writing instrument having an excellent cap-off performance as described in any of the above items (1) to (5), wherein the substance providing a cap-off property which is added to the ink is at least one selected from glycerin derivatives, alkylphosphoric acid esters, polyoxyethylenesorbitan fatty acid esters, polyoxyethylenesorbit fatty acid esters, paraffin wax, microcrystalline wax, polyolefin wax, pentaerythritol derivatives and lecithin.

(8) The writing instrument having an excellent cap-off performance as described in any of the above items (1) to (6), being a direct liquid writing instrument comprising an ink tank part which is a barrel for directly storing an ink and a collector member for temporarily reserving the ink, wherein the ink is derived from the ink tank part to the pen tip directly or via a feed.

(9) The writing instrument having an excellent cap-off performance as described in any of the above items (1) to (6), being a writing instrument having an ink reservoir absorbing an ink in a barrel, wherein the ink is derived from the ink reservoir to the pen tip directly or via a feed.

BEST MODE FOR CARRYING OUT THE INVENTION

Figure 1:
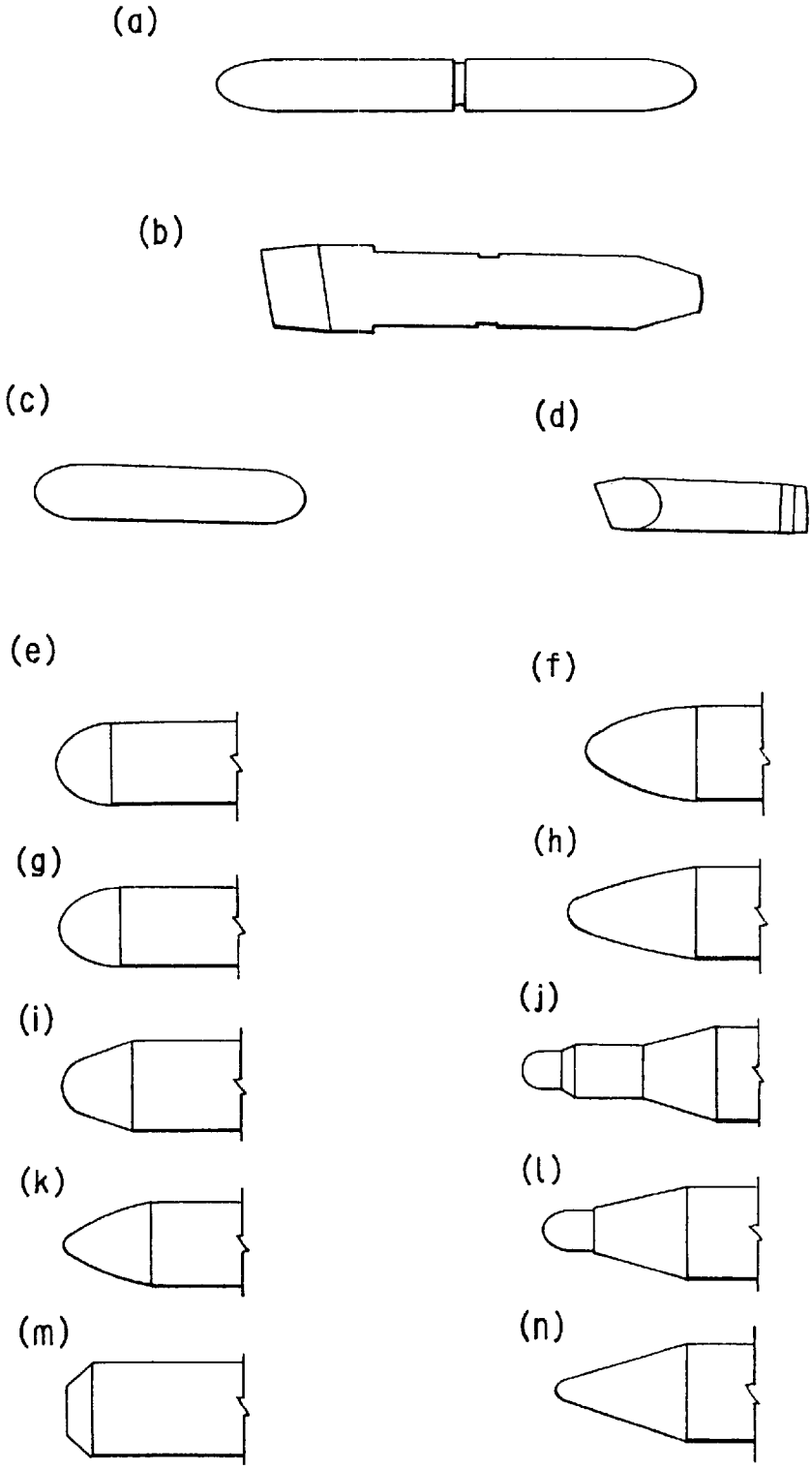
FIGS. 1(*a*) to (*n*) are explanatory drawings for explaining a structure of the pen tip comprising a fibrous feed according to the present invention, and FIGS. 2(*a*) to (*j*) are explanatory drawings for explaining a structure of the pen tip comprising a plastic feed according to the present invention.

The present invention shall be explained in more details with reference to attached drawings.

The writing instrument having an excellent cap-off performance in the first embodiment of the present invention is characterized by that in the writing instrument having a pen tip comprising a fibrous feed or a plastic feed, the pen tip described above is coated with a substance which is solid at room temperature and in which a solubility in an ink solvent is 10% or less at room temperature and which repeatedly and constantly films on a surface part of the pen tip that can be broken by writing pressure in writing, among substances providing the pen tip with a cap-off property.

The writing instrument having an excellent cap-off performance in the second embodiment of the present invention is characterized by that in the writing instrument having a pen tip comprising a fibrous feed or a plastic feed, the pen tip described above is coated with a substance which has a melting point (mp) of 40 to 95° C. and in which a solubility in an ink solvent is 10% or less at room temperature among substances providing the pen tip with a cap-off property.

Further, the writing instrument having an excellent cap-off performance in the third embodiment of the present invention is characterized by that in the writing instrument having a pen tip comprising a fibrous feed or a plastic feed, the pen tip described above is coated with a substance which is solid at room temperature and has a melting point (mp) of 40 to 95° C. and in which a solubility in an ink solvent is 10% or less at room temperature among the substances providing the pen tip with a cap-off property and that a substance which is solid at room temperature and in which a solubility in an ink solubility is 0.01 to 10% at room temperature among the substances providing a cap-off property is added to the ink in the writing instrument.

The coating substance used in the first to third embodiments (hereinafter, these three embodiments shall be referred to merely as ⌈embodiment⌋) of the present invention is a substance which is solid at room temperature(25° C. or lower, the same shall apply hereinafter) and in which a solubility in an ink solvent is 10% or less, preferably 5% or less and more preferably 1% or less at room temperature among the substances providing a pen tip with a cap-off property. A lower limit value of the solubility includes 0% and is preferably 0.01% or more and more preferably 0.1% or more.

Among the substances providing a pen tip with a cap-off property, those which are liquid at room temperature or those in which a solubility in an ink solvent exceeds 10% at room temperature are eluted in an ink solvent by virtue of a dissolution or diffusion action and reduced in an effect by storage over a long period of time or loses an effect as the ink decreases by using the pen, so that they can not achieve the effects of the present invention.

The term "the solubility in an ink solvent is 10% or less at room temperature" described above means that in the coating substance, a solubility in the ink solvent (a solvent comprising an organic solvent which is an ink component described later) used in the present invention is 10% or less at room temperature.

More preferred coating substance is a substance which has the characteristics described above, and among the substances providing the pen tip with a cap-off property, preferred are those having a melting point (mp) of 40 to 95° C., preferably 50 to 85° C. and more preferably 60 to 75° C.

In the writing instrument using the coating substance having a melting point (mp) of 40 to 95° C., that is, the writing instrument of the second embodiment, more substance providing the pen tip with a cap-off property than required is not eluted in the ink and therefore a drying time of the drawn lines written on a non-absorbing face of glass is shortened.

The coating substance used in the embodiment of the present invention shall not specifically be restricted as long as it has the characteristics described above, that is, the characteristics that it is solid at room temperature and has preferably a melting point of 40 to 95° C. and that the solubility in an ink solvent is 10% or less at room temperature. It includes, for example, at least one or mixtures of two or more kinds selected from glycerin derivatives such as diglycerin monostearate, triglycerin monostearate, pentaglyceryl tristearate, hexaglyceryl tristearate and decaglycerin distearate, alkylphosphoric acid esters such as polyoxyethylene-stearyl phosphate, polyoxyethylenesorbitan fatty acid esters such as polyoxyethylenesorbitan monostearate and polyoxyethylenesorbitan tristearate, polyoxyethylenesorbit fatty acid esters such as polyoxyethylenesorbit hexastearate, paraffin wax, microcrystalline wax, pentaerythritol derivatives such as pentaerythritol monostearate and pentaerythritol distearate, lecithin, saccharose esters, polyolefin wax, ascorbic acid stearate and sorbic acid stearate each having the characteristics described above.

Preferably, it is solid (more preferably having a melting point of 40 to 95° C.) at room temperature and has a solubility of 10% or less in a solvent at room temperature. Further, from a viewpoint of a difficulty in allowing the substance providing a cap-off property to be dissociated by physical friction at the pen tip and flow-out of the ink, preferred are diglycerin monostearate, pentaglyceryl tristearate, polyoxyethylene-stearyl phosphate, lecithin, paraffin wax, microcrystalline wax and polyolefin wax because the harder property and the lower solubility elevates the durability and the effects.

The specific examples of various coating substances having the characteristics described above have been given as described above (from diglycerin monostearate to sorbic acid stearate). In the second embodiment, selected are those in which a melting point (mp) falls in a range of 40 to 95° C. among these various coating substances.

In the embodiment of the present invention, a coating method for the substance providing a pen tip with a cap-off property and having the characteristics described above shall not specifically be restricted as long as the amount required for allowing the effects of the present invention to be exhibited is coated on the pen tip comprising a fibrous feed or a plastic feed. The substance having the characteristics described above can be coated by, for example, dissolving it in a solvent dissolving the above substance, subjecting the pen tip to dipping treatment in or spraying treatment with it and then drying by heating or at room temperature. When the solubility is extremely low, the substance can be coated by dipping the pen tip in the heated solution thereof and cooling it.

These coating methods are excellent as a method which is easy and inexpensive.

The solvents for dissolving the substance having the characteristics described above include, for example, alcohols such as methyl alcohol, ethyl alcohol, n-propyl alcohol and isopropyl alcohol (i-propyl alcohol), glycols such as ethylene glycol monomethyl ether, ethylene glycol monoethyl ether and propylene glycol monomethyl ether, ketones such as acetone and methyl ethyl ketone, esters such as methyl acetate, ethyl acetate, butyl acetate, ethylene glycol monomethyl ether acetate and propylene glycol monoethyl ether acetate, ethers such as dimethyl ether and diethyl ether, hydrocarbons such as hexane, heptane and methylcyclohexane, and chlorinates compounds such as chloroform and methylene chloride.

An amount of the substance having the characteristics described above coated on the pen tip is 0.01 to 20% by weight, preferably 0.1 to 10% by weight and more preferably 0.3 to 5% by weight in terms of a weight ratio.

If the coating amount is less than 0.01% by weight, the effects of the present invention can not be achieved, and if it exceeds 20% by weight, the ink passage at the pen tip is not preserved, and the ink is hard to be discharged, so that starving is caused or as writing goes on. Accordingly, it is not preferred.

In the embodiment of the present invention, a material, a structure and a production method of the pen tip used shall not specifically be restricted and include, for example, pen tips comprising fibrous feeds obtained by processing parallel fiber bundles comprising one or a combination of two or more kinds of natural fibers, animal hair fibers, polyacetal base resins, acryl base resins, polyester base resins, polyamide base resins, polyurethane base resins, polyolefin base resins, polyvinyl base resins, polycarbonate base resins, polyether base resins and polyphenylene base resins and fiber bundles of felt and the like or fibrous feeds prepared by subjecting these fibrous feeds to processing with resins, plastic feeds obtained by forming ink grooves in an axial direction of the various plastic materials described above, and porous substances obtained by melting and bonding powders of the various plastic powders described above. The forms thereof include optional ones such as tabular substances, fiber-converged substances, sintered substances and foamed substances.

Figure 2:
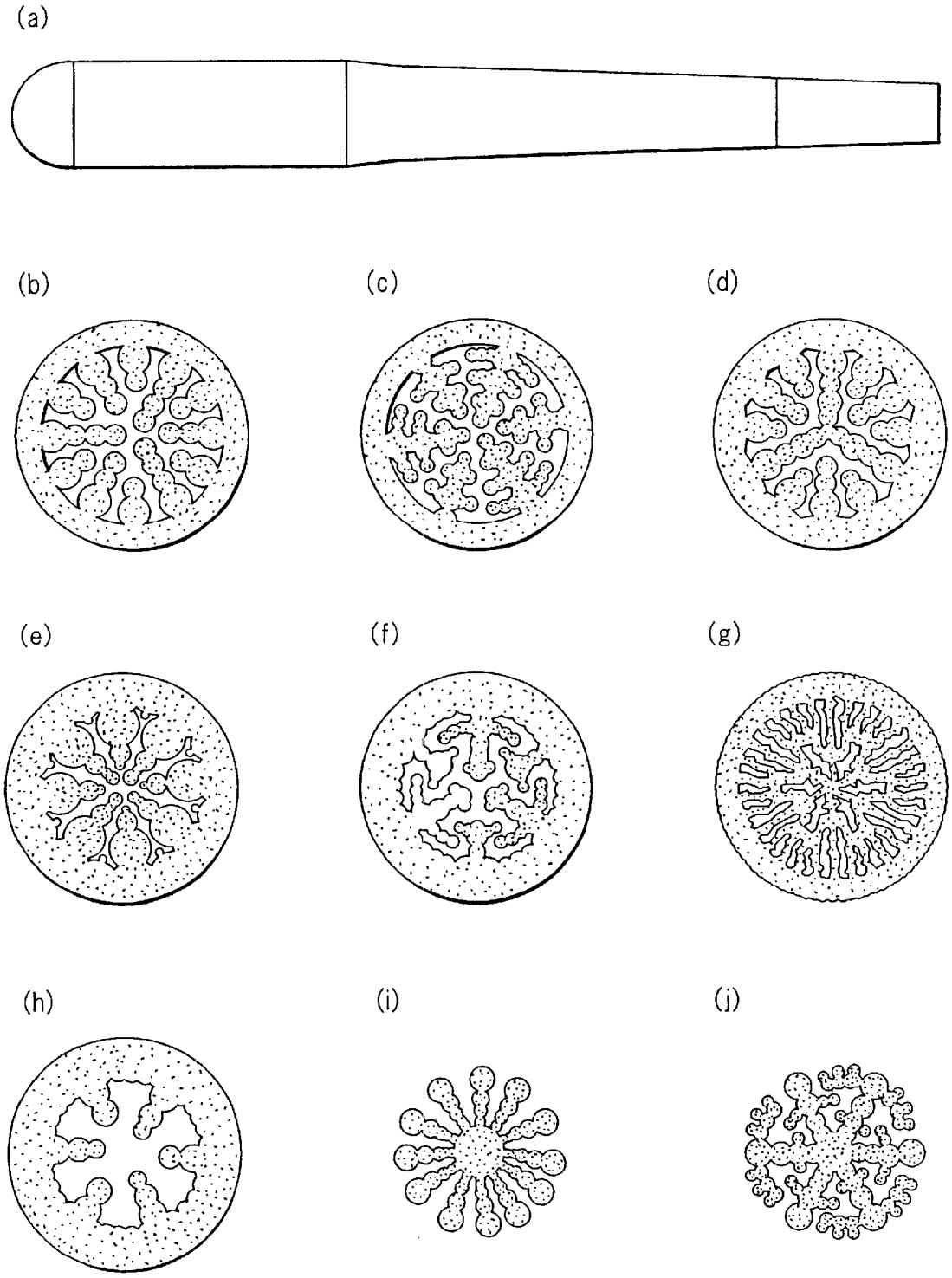

A specific shape of the pen tip used comprising a fibrous feed includes, for example, those shown in FIG. 1 (*a*) to (*n*). Further, an embodiment of the ink groove at the pen tip comprising a plastic feed shown in FIG. 2(*a*) in which an ink groove is formed in an axial direction of the various plastic materials described above includes, for example, those having structures shown in FIG. 2(*b*) to (*j*).

In order to coat the pen tip with the substance having the characteristics described above to obtain the intended writing instrument having an excellent cap-off performance, those having preferably a porosity of 30 to 75% and a slit size of about 1 to 20 $\mu$m are preferred when a fibrous feed is used for the pen tip, and those having preferably an average slit size of 20 to 40 μm are preferred when a plastic feed is used for the pen tip. The porosity and slit size described above shall not be restricted to the value ranges described above as long as the object of the present invention can be achieved by coating the pen tip with the substance having the characteristics described above.

Further, the slit size described above is calulated from the following equation:

$$\text{slit size}=\text{porosity}\times(\text{radius of yarn})/(1-\text{porosity})$$

Inks used for the writing instrument in the embodiment of the present invention shall not specifically be restricted as long as they have oil-ink components usually used for a marking pen, a sign pen and a brush pen, and capable of being used are, for example, colorants, organic solvents, resins which can be dissolved in the above organic solvents and other additives for a writing instrument.

The colorants include oil-soluble dyes and pigments, and almost all of conventional oil-soluble dyes which can be dissolved in organic solvents can be used as the oil-soluble dyes. The dyes include, for example, Orazol Yellow 2GLN, Orazol Red 3GL, Orazol Blue 2GLN, Neonzapon Blue FLE, Spirit Black SP, Parifast Red 1308, Oil Blue BA, Oil Yellow 185, Oil Red TR71, Oil Black S, Victoria Blue, Rhodamine 6JHSA and Flex Yellow 105, and the pigments shall not specifically be restricted and include, for example, azo base pigments, condensed polyazo base pigments, phthalocyanine base pigments, metal complex salt pigments, thioindigo pigments, dye lake pigments, organic pigments such as fluorescent pigments, carbon black, and inorganic pigments such as titanium oxide. Further, capable of being used as well are processed pigments the surfaces of which are processed by resin coating, for example, various Microlys A types, AS Black, AS Blue and IK Red. These dyes and/or pigments can be used alone or in a mixture of two or more kinds thereof. A use amount thereof is different according to the kind of the colorant and the other ink components and is 1 to 30% by weight, preferably 2 to 15% by weight based on the total amount of the ink.

The organic solvents include lower alcohols such as ethyl alcohol, propyl alcohol and isopropyl alcohol, aromatic hydrocarbons such as toluene and xylene, lower aliphatic ketones such as methyl ethyl ketone and methyl isobutyl ketone, lower alcohol esters of lower fatty acids such as ethyl acetate and butyl acetate, aliphatic hydrocarbons such as hexane and heptane, alicyclic hydrocarbons such as cyclohexane and ethylcyclohexane, alkyl alcohols of glycols, and glycol ethers such as propylene glycol monomethyl ether. They can be used alone or in a mixture of two or more kinds thereof. A use amount thereof is 50 to 90% by weight, preferably 70 to 85% by weight based on the total amount of the ink.

A resin is used as a film-forming agent, a sticking agent onto a coated face, a viscosity-controlling agent for the ink and a dispersant for the colorant, and various natural resins and synthetic resins which have so far been used can be used. It includes, for example, rosin, ester gums, rosin base such as maleic acid-modified rosin and phenol-modified rosin, cellulose base resins such as ethyl cellulose and nitrocellulose, vinyl base resins such as polyvinylbutyral and vinyl chloride-vinyl acetate copolymer resins, petroleum base resins, ketone base resins, acryl base resins, condensation products of aldehyde and urea and a maleic acid resin. They can be used alone or in a mixture of two or more kinds thereof. A use amount thereof is 0.1 to 30% by weight, preferably 1 to 20% by weight based on the total amount of the ink.

Other additives for a writing instrument include, for example, anionic, nonionic and cationic surfactants, preservatives, fungicides, rust preventives, lubricants and pH-controlling agents.

Substantially the same coating substances described above can be used for the ink additive providing a cap-off property used in the third embodiment of the present invention and include those which are solid at room temperature and in which a solubility in the ink solvent is 0.01 to 10%, preferably 0.01 to 5%, more preferably 0.1 to 4% and further more preferably 0.1 to 3% at room temperature among the substances providing the pen tip with a cap-off property.

Among the ink additives providing the pen tip with a cap-off property, those which are liquid at room temperature or those in which a solubility in the ink solvent exceeds 10% are eluted in the ink solvent by virtue of a dissolution or diffusion action and reduced in further effect by storage over a long period of time or lose further effect as the ink decreases by using the pen, and therefore they are not preferred.

The term "a solubility in the ink solvent is 0.01 to 10% at room temperature" described above means that a solubility of the ink additive in the ink solvent (the solvent comprising an organic solvent which is the ink component described above) is 0.01 to 10% at room temperature.

Among the ink additives providing a pen tip with a cap-off property, more preferred ink additives are those which have a melting point (mp) of 40 to 95° C., preferably 50 to 85° C. and more preferably 60 to 75° C. and in which a solubility in the ink solvent is 0.01 to 10%, preferably 0.01 to 5%, more preferably 0.1 to 4% and further more preferably 0.1 to 3% at room temperature.

The ink additive used in the third embodiment of the present invention shall not specifically be restricted as long as it has the characteristics described above, that is, the characteristics that it is solid at room temperature and has preferably a melting point of 40 to 95° C. and that the solubility in the ink solvent is 0.01 to 10% at room temperature. It includes, for example, at least one or mixtures of two or more kinds selected from glycerin derivatives such as diglycerin monostearate, triglycerin monostearate, pentaglyceryl tristearate, hexaglyceryl tristearate and decaglycerin distearate, alkylphosphoric acid esters such as polyoxyethylene-stearyl phosphate, polyoxyethylenesorbitan fatty acid esters such as polyoxyethylenesorbitan monostearate and polyoxyethylenesorbitan tristearate, polyoxyethylenesorbit fatty acid esters such as polyoxyethylenesorbit hexastearate, paraffin wax, microcrystalline wax, pentaerythritol derivatives such as pentaerythritol monostearate and pentaerythritol distearate, lecithin, saccharose esters, polyolefin wax, ascorbic acid stearate and sorbic acid stearate each having the characteristics described above.

Preferred are diglycerin monostearate, pentaglyceryl tristearate, polyoxyethylenestearyl phosphate and lecithin because they are solid (more preferably having a melting point of 40 to 95° C.) and have a solubility of 0.01 to 10% in a solvent at room temperature.

An amount of the ink additive having the characteristics described above added to the ink is 0.01 to 10% by weight, preferably 0.05 to 5% by weight and more preferably 0.1 to 1% by weight ink in terms of a weight ratio based on the total amount of the ink.

If the amount thereof added to the ink is less than 0.01% by weight, further effects of the present invention can not be achieved. On the other hand, if it exceeds 10% by weight, drying time of the drawn lines is delayed and storage over an extended period of time or repeating of low and high temperatures produces precipitations in the ink and brings about clogging in the ink passage to reduce the writing property. Accordingly, it is not preferred.

In the writing instrument of the third embodiment of the present invention, the coating substance providing the pen tip with a cap-off property is coated, and the ink additive providing the pen tip with a cap-off property is further added to the ink, so that it can further exhibit the effects of the present invention as compared with the writing instrument of the first or second embodiment.

The structure of the writing instrument of the embodiment of the present invention shall not specifically be restricted as long as it is a structure having a pen tip comprising a fibrous feed or a plastic feed which is usually used for a marking pen, a sign pen and a brush pen, and it can be applied as well to a writing instrument having a cap for a writing instrument and a writing instrument having no cap for a writing instrument.

In the embodiment of the present invention, capable of being achieved is the writing instrument which provides a good writing performance even after the pen tip is left standing in the air for long time and is excellent in a cap-off performance. It includes, for example, the structures of the conventional writing instruments having a cap for a writing instrument shown in FIG. 3 to FIG. 7, the structures of a marking pen, a sign pen and a brush pen each having a simple sealing mechanism and the structures of a marking pen, a sign pen and a brush pen of a knocking type requiring no cap for a writing instrument shown in FIG. 8.

Figure 3:
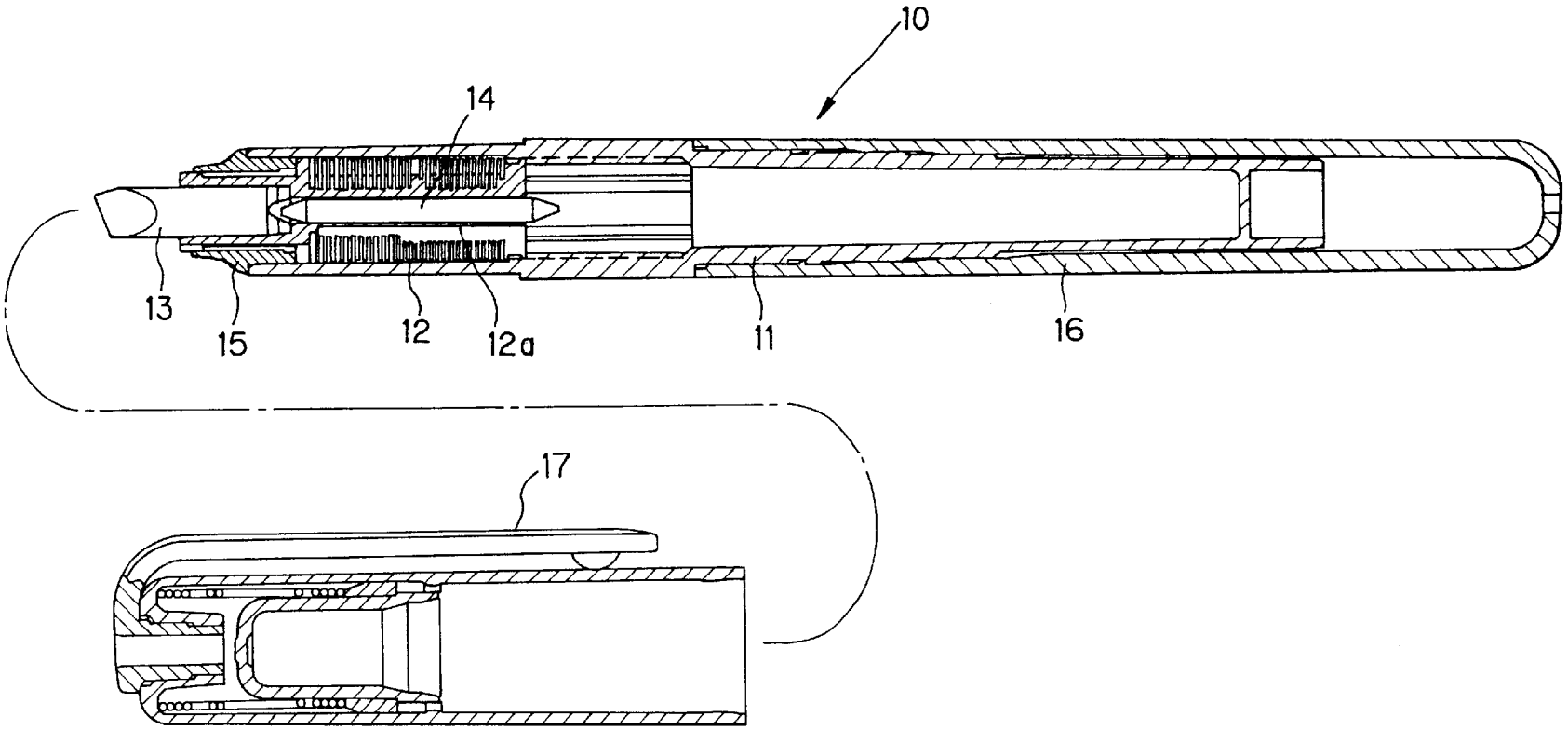
FIG. 3 is an explanatory drawing showing one example by a cross sectional embodiment, in which the writing instrument of the present invention is applied to a direct liquid type writing instrument.

A direct liquid type writing instrument is shown in FIG. 3, and the above direct liquid type writing instrument 10 has a structure in which it has an ink tank part 11 which is a barrel for directly storing an ink without absorbing it in a sliver and an ink holder (collector member) 12 for temporarily holding the ink so that the ink which is pushed out from the ink tank when air contained in the ink tank part 11 is expanded by a rise in a temperature is prevented from dropping from the pen tip or the air vent is disposed in a front part of the ink tank part 11 and in which a pen tip 13 comprising a fibrous feed is disposed in a tip part of the collector member 12. The ink is introduced from the ink tank part 11 into the pen tip 13 by introducing the ink from the ink tank part 11 into the pen tip 13 via a feed 14 provided with an ink passage, which is disposed in a central hole 12*a* of the collector member 12.

In FIG. 3, a holder member is shown by 15; a rear barrel fixed to a rear part of the ink tank part 11 is shown by 16; and a cap is shown by 17. A rear part of the pen tip 13 may be disposed directly in the ink tank part 11 to introduce the ink without passing through the feed 14.

Figure 4:
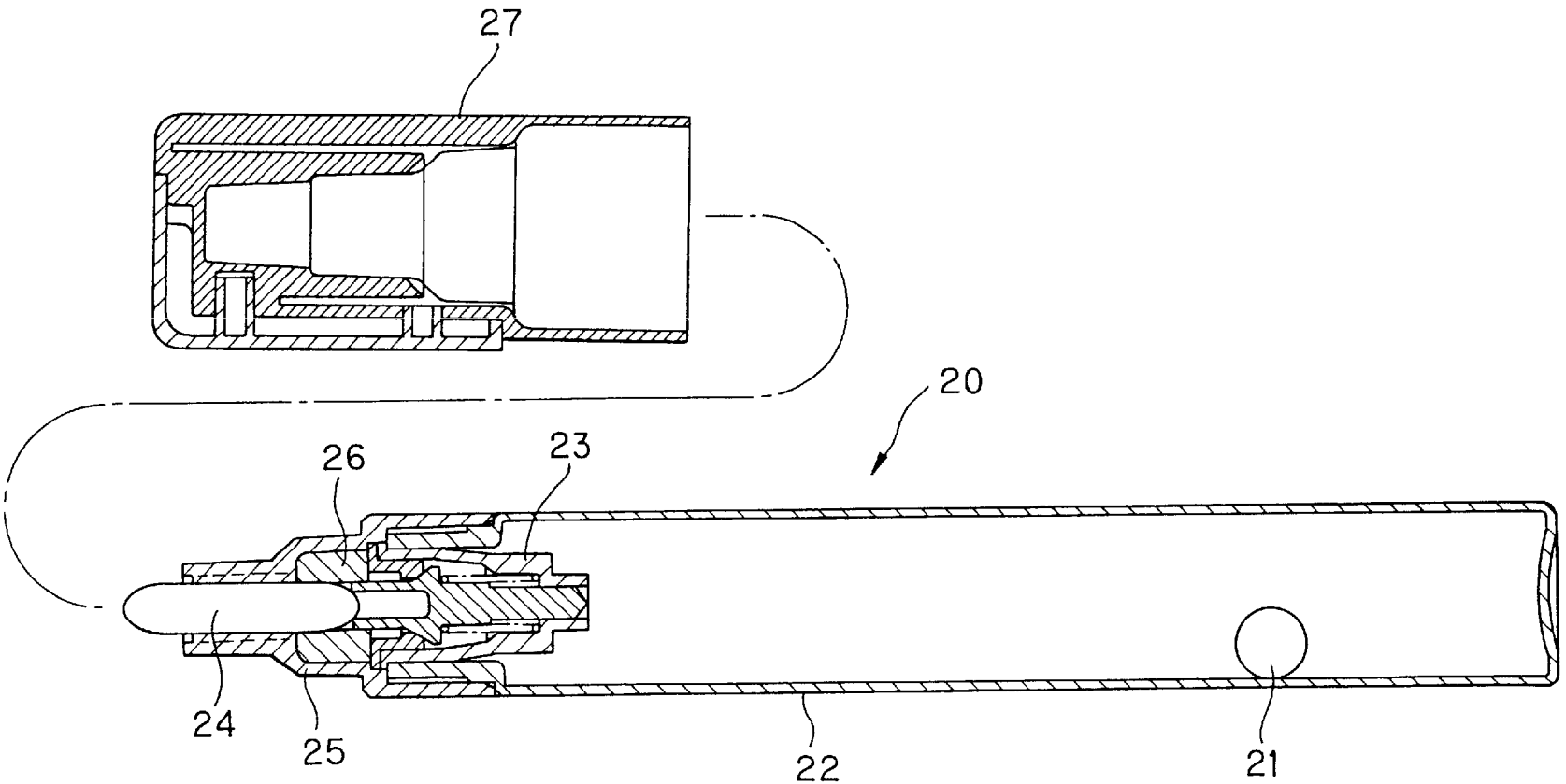
FIG. 4 is an explanatory drawing showing by a cross sectional embodiment, one example in which the writing instrument of the present invention is applied to a writing instrument equipped with a valve mechanism.

A writing instrument 20 shown in FIG. 4 is a valve type writing instrument containing therein a steel ball 21 which is a stirring ball, and it has an ink tank part 22 which is a barrel for directly storing an ink without absorbing the ink in a sliver and is constituted so that the ink is fed to a pen tip 24 comprising a fibrous feed via a valve mechanism 23. In FIG. 4, a holder member is shown by 25; shown by 26 is a holder member which is interposed between the valve mechanism 23 and the holder member 25 to hold a rear part of the pen tip 24; and a cap is shown by 27.

Figure 5:
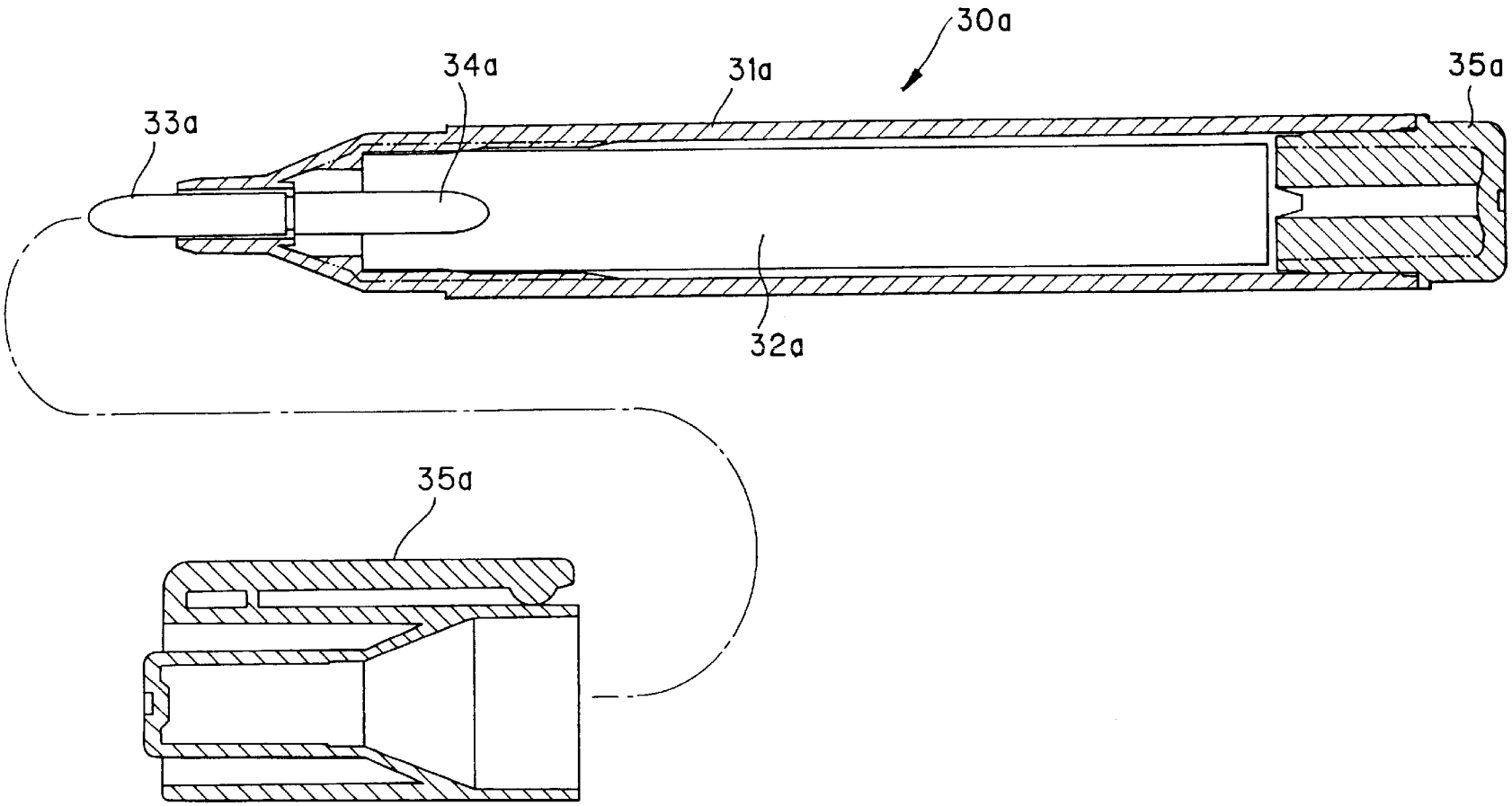
FIGS. 5 and 6 are explanatory drawings each showing by a cross sectional embodiment, examples of a type in which an ink is absorbed in an ink reservoir such as a sliver in the writing instrument of the present invention.
Figure 6:
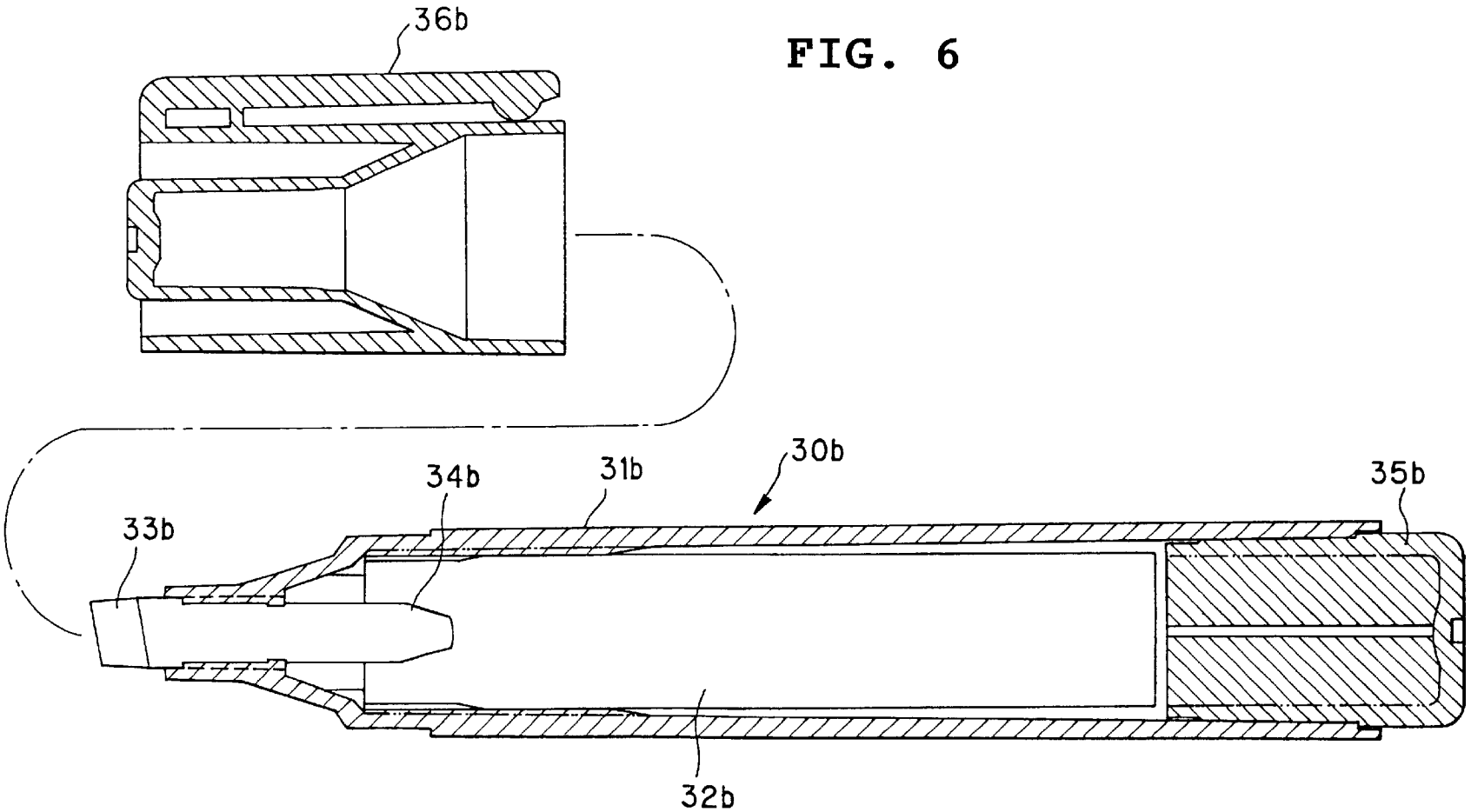

Writing instruments of a type in which an ink is absorbed in an ink reservoir such as a sliver are shown in FIG. 5 and FIG. 6. The above respective writing instruments 30*a*, 30*b* have ink reservoirs 32*a*, 32*b* absorbing inks in fibrous substances such as a sliver in barrel bodies 31*a*, 31*b* which are barrels and are constituted so that rear end parts 34*a*, 34*b* of pen tips 33*a*, 33*b* comprising fibrous feeds are brought into contact with front parts of the ink reservoirs 32*a*, 32*b* to thereby feed the inks contained in the ink reservoirs 32*a*, 32*b*, to the pen tips 33*a*, 33*b*. Plugs fixed to rear end parts of the barrel bodies 31*a*, 31*b* are shown by 35*a*, 35*b*, and caps are shown by 36*a*, 36*b*. A difference between the writing instruments shown in FIG. 5 and FIG. 6 resides in that the shapes of the barrel bodies 31*a*, 31*b* and the pen tips 33*a*, 33*b* and the structures of the plugs 35*a*, 35*b* are a little different.

Figure 7:
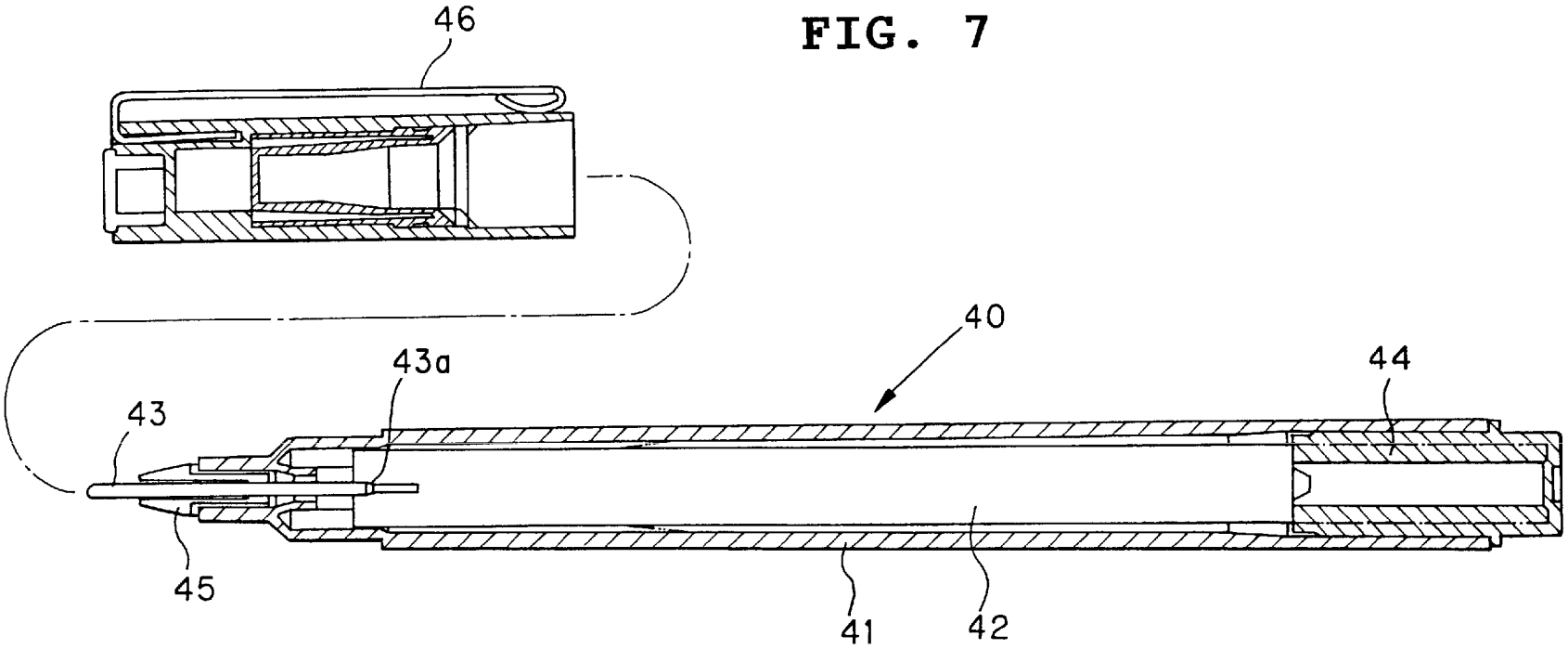
FIG. 7 is an explanatory drawing showing by a cross sectional embodiment, another example of a type in which an ink is absorbed in an ink reservoir such as a sliver in the writing instrument of the present invention.

A writing instrument of a sign pen type in which an ink is absorbed in an ink reservoir such as a sliver as is the case with the writing instrument shown in FIG. 5 is shown in FIG. 7. The above writing instrument 40 has an ink reservoir 42 absorbing an ink in a fibrous substance such as a sliver in a barrel body 41 which is a barrel and is constituted so that a rear end part 43*a* of a pen tip 43 comprising a plastic feed is brought into contact with a front part of the ink reservoir 42 to thereby feed the ink contained in the ink reservoir 42 to the pen tip 43. A plug fixed to a rear end part of the barrel body 41 is shown by 44; a holder member is shown by 45; and a cap is shown by 46.

Figure 8:
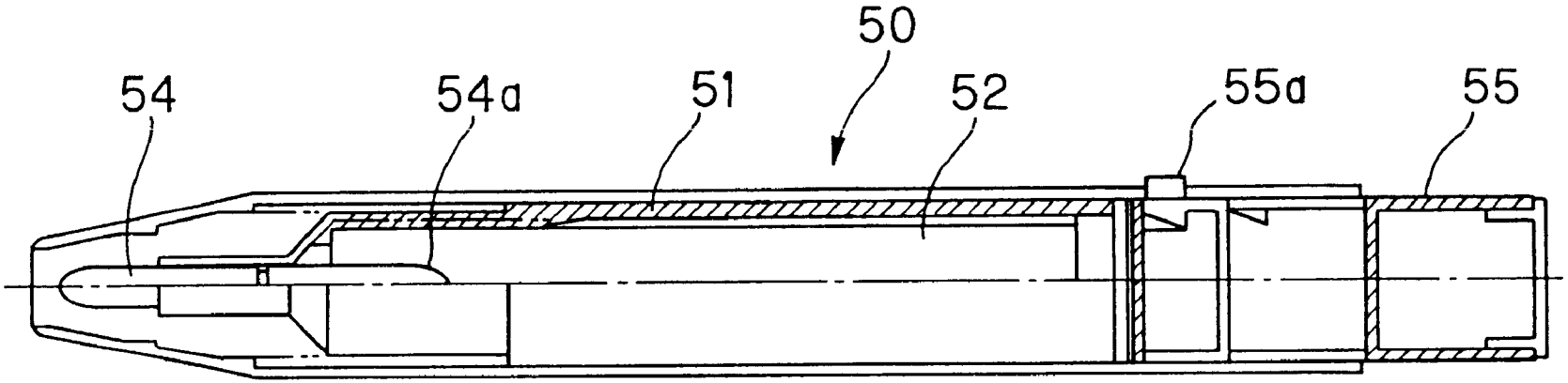
FIG. 8 is an explanatory drawing showing by a cross sectional embodiment, one example in which the writing instrument of the present invention is applied to a writing instrument of a knocking type.

Shown in FIG. 8 is a knocking type writing instrument of a sign pen type requiring no cap in which an ink is absorbed in an ink reservoir such as a sliver. The above writing instrument 50 is equipped with an internal barrel having an ink reservoir 52 absorbing an ink in a fibrous substance such as a sliver in a barrel body 51 and is constituted so that a rear end part 54*a* of a pen tip 54 comprising a fibrous feed is brought into contact with a front part of the ink reservoir 52 to thereby feed the ink contained in the ink reservoir 52 to the pen tip 54. A knocking part mounted to a rear end part of the barrel 51 is shown by 55, and it is constituted so that the pen tip 54 comes out of the barrel body 51 to fall in a writing state by pushing out the above knocking part forward and that the pen tip 54 is received in the barrel body 51 by operating a releasing button 55*a*.

In the writing instrument of the present invention which is constituted in such manner as described above, the pen tip comprising a fibrous feed or a plastic feed is coated with the respective substances described above which are solid at room temperature and has preferably a melting point of 40 to 95° C. and in which a solubility in the solvent is 10% or less at room temperature among the substances providing the pen tip with a cap-off property, whereby a very fragile film can be formed on a surface part of the pen tip, and this film prevents the solvent which is a volatile component contained in an ink from vaporizing. Further, the above film is broken by writing pressure in writing to make writing possible. In addition, the substance providing a cap-off property coated on the pen tip is dissolved again, though formation of the above film is a little different depending on the coating amount described above, in the ink by a required amount, and next time when the pen tip is exposed to the air, a new film is formed on a pen tip surface by virtue of interaction with the ink solvent. This procedure of film formation→writing→film formation →writing - - - is repeated many times to constantly show the effect.

Accordingly, the writing instrument of the present invention shows such an excellent cap-off performance that a good writing performance is achieved even after the pen tip is left standing in the air for long time. Further, the substance providing a cap-off property is not contained in the ink components, so that the preservability at a low temperature is good, and clogging is not caused in the ink passage.

In the writing instrument of the second embodiment, more substance providing the pen tip with a cap-off property than required is not eluted in the ink, and therefore drying time of the drawn lines written on a non-absorbing face of glass is shortened.

Further, in the writing instrument of the third embodiment, the coating substance providing the pen tip with a cap-off property is coated, and the ink additive providing the pen tip with a cap-off property is further added to the ink in an addition amount in which the writing performance is not deteriorated, so that a synergistic effect in which the effects of the writing instruments of the first embodiment and the second embodiment are multiplied synergistically is exhibited, that is, the cap-off performance is such further excellent that further better writing performance is achieved even after the pen tip is left standing in the air for long time (these points shall be described in details with reference to examples).

It is a matter of course that the writing instrument of the present invention shall not be restricted to the embodiments described above and that they can be changed to various forms as long as the scope of the present invention is not changed.

The writing instrument of the present invention shall not be restricted to, for example, a direct liquid type writing instrument in which the ink of the embodiment described above is directly stored without absorbing it in a sliver, a writing instrument equipped with a valve mechanism and a writing instrument in which an ink is absorbed in an ink reservoir such as a sliver. It shall not specifically be restricted as long as the pen tip comprising a fibrous feed or a plastic feed is coated with various substances having the characteristics described above or the ink additive providing a cap-off performance is added to the ink, and it can be applied as well to, for example, brush pens, cartridge type pens and applicators for cosmetics.

In particular, the writing instrument which provides a good writing performance even after the pen tip is left standing in the air for long time with the cap off and which is excellent in a cap-off performance can be achieved in the present invention, and therefore it can suitably be used for writing instruments having structures of a marking pen, a sign pen and a brush pen of a knocking type requiring no cap.

EXAMPLES

The present invention shall be explained in further details with reference to examples and comparative examples, but the present invention shall not be restricted to the following examples.

Examples 1 to 14 and Comparative Examples 1 to 4 and 6 to 11

Figure 9:
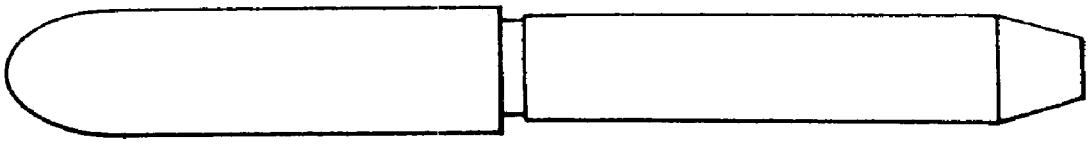
FIG. 9 is an explanatory drawing showing the pen tip structure used in the examples of the present invention and the comparative examples.

A pen tip shown in FIG. 9 was used as the pen tip. A making pen (ink amount: 4.5 g) prepared by installing this pen tip into a writing instrument shown in FIG. 5 was used.

The pen tip was a fibrous feed comprising a sliver of acryl fibers, and used was one having a weight of 0.19 g, a length of 37 mm and a diameter of 4.0 mm (porosity: about 60%).

Used as the coating substances (agents) were (1) hexaglyceryl tristearate (melting point: 57° C.), (2) polyoxyethylenesorbitan monostearate (melting point: 53° C.), (3) polyoxyethylenestearyl phosphate (melting point: 56° C.), (4) microcrystalline wax (melting point: 67° C., ⌈Hi-Mic-2045⌋ manufactured by Nippon Seiro Co., Ltd.) and (5) paraffin wax (melting point: 61° C., ⌈Paraffin Wax 140⌋ manufactured by Nippon Seiro Co., Ltd.).

The solubilities of the substances (1) to (5) described above in an ink solvent (solvent comprising ethyl alcohol, n-propyl alcohol, i-propyl alcohol and propylene glycol monomethyl ether) were 0.4% in (1), 9% in (2), 0.1% in (3), 0.1% or less in (4) and 0.1% or less in (5).

The coating substance of the prescribed amount described above was dissolved in methylene chloride which was a solvent, and the pen tip comprising a fibrous feed described above was dipped in the solution prepared above and heated at 50° C. for one hour. Then, it was left standing at room temperature a night and then poured into a mesh-shaped vessel to remove the solvent. Next, the pen tip was dried at room temperature for one hour, at 50° C. for 3 hours and at room temperature for 3 hours to prepare a sample, and assembled was a marking pen (ink amount: 4.5 g) in which the above pen tip was installed into the writing instrument shown in FIG. 5. This marking pen was used to carry out the following tests.

The coating amount was shown by a difference in a weight of the pen tip between before and after treating which corresponded to an amount of the coating agent of (1) to (5) described above adhered to the pen tip, and it was shown by weight % based on the weight of the pen tip before processing. Those having treating rates of 1%, 2% and 3% were used in the examples.

Inks (1) to (10) comprising compositions shown in the following Table 1 were used for the inks.

Comparative Example 5

The same ones as those in Examples 1 to 14 and Comparative Examples 1 to 4 and 6 to 11 were used for the pen tips and the marking pens which were the use members.

The pen tip was treated by dipping the pen tip comprising a fibrous feed described above in benzyl alcohol (melting point: −15.5° C.), and then the above pen tip was installed in a writing instrument shown in FIG. 5 immediately so that benzyl alcohol was not dried to assemble a marking pen (ink amount: 4.5 g). The coating amount was about 0.2 g, though scattered because of scattering in drying benzyl alcohol and a shape of the pen tip. This assembled marking pen was left standing at room temperature for a day and then used to carry out the following tests.

TABLE 1

| Ink composition | Ink composition (1) | (2) | (3) | (4) | (5) | (6) | (7) | (8) | (9) | (10) |
|---|---|---|---|---|---|---|---|---|---|---|
| Ethyl alcohol | 75.0 | — | 74.0 | — | 74.0 | — | 74.6 | — | 73.6 | — |
| n-Propyl alcohol | — | 14.0 | — | 14.0 | — | 14.0 | — | 14.0 | — | 14.0 |
| i-Propyl alcohol | 7.5 | — | 7.5 | — | 7.5 | — | 7.5 | — | 7.5 | — |
| Propylene glycol monomethyl ether | — | 70.0 | — | 68.0 | — | 68.0 | — | 69.8 | — | 68.8 |
| Laropearl A101*1 | — | 12.0 | — | 12.0 | — | 12.0 | — | 12.0 | — | 12.0 |
| Alresat KM400*2 | 10.0 | — | 10.0 | — | 10.0 | — | 10.0 | — | 10.0 | — |
| Victoria Blue BSA*3 | 2.5 | 3.0 | 2.5 | 3.0 | 2.5 | 3.0 | 2.5 | 3.0 | 2.5 | 3.0 |
| Rhodamine 6JHSA*4 | 2.5 | 1.0 | 2.5 | 1.0 | 2.5 | 1.0 | 2.5 | 1.0 | 2.5 | 1.0 |
| Flex Yellow 105*5 | 2.5 | — | 2.5 | — | 2.5 | — | 2.5 | — | 2.5 | — |
| Hexaglyceryl tristearate*6 | — | — | 1.0 | — | | — | 0.4 | — | 0.4 | — |
| Polyoxyethylenesorbitan monostearate*7 | — | — | — | 2.0 | — | — | — | — | — | — |
| Polyoxyethylenestearyl phosphate*8 | — | — | — | — | — | — | — | 0.2 | — | 0.2 |
| Microcrystalline wax*9 | — | — | — | — | 1.0 | — | — | — | 1.0 | — |
| Paraffin wax*10 | — | — | — | — | — | 2.0 | — | — | — | 1.0 |
| | | | | | | | | | | (wt %) |

*1Condensation product of aldehyde and urea (manufactured by BASF Co., Ltd.)
*2Maleic acid resin (manufactured by Hoechst Co., Ltd.)
*3Dye (manufactured by Zeneca Co., Ltd.)
*4Dye (manufactured by Zeneca Co., Ltd.)
*5Dye (manufactured by Zeneca Co., Ltd.)
*6Coating agent (1) (cap-off performance-providing ink additive)
*7Coating agent (2) (cap-off performance-providing ink additive)
*8Coating agent (3) (cap-off performance-providing ink additive)
*9Coating agent (4) (cap-off performance-providing ink additive, [Hi-Mic-2045])
*10Coating agent (5) (cap-off performance-providing ink additive, [Paraffin Wax 140])

The marking pens obtained in Examples 1 to 14 and Comparative Examples 1 to 11 were used to carry out evaluation of a writing performance, a cap-off test after storing at a low temperature, a cap-off test after writing, a drawn line-drying test and overall evaluation.

These results are shown in the following Table 2 and Table 3.

Cap-off Test

The caps of the respective marking pens were taken off, and the writing performances at 25° C. based on a change in a cap-off time with the passage of time (one hour to one month) were measured according to the following evaluation criteria. When the evaluation is ⊙ even after one day or longer passes, preferably 3 day or longer pass, it shows that the cap-off performance is excellent.

Evaluation Criteria

⊙: writable without starving

○: slightly starving at the beginning of writing

Δ: starving in the first line

▲: starving in the second line

×: unwritable

Cap-off Test After Storing at a Low Temperature

The respective marking pens were left standing at 0° C. for 24 hours and then slowly returned to room temperature in one day. The caps were taken off as was the case with the writing performance evaluation described above to compare the writing performances based on a change in a cap-off time with the passage of time with the evaluation results at 25° C. described above and evaluate them according to the following evaluation criteria.

⊙: same as the cap-off performance at 25° C. before storing at a low temperature ○: cap-off performance is a little reduced as compared with the cap-off performance at 25° C. before storing at a low temperature ×: cap-off performance is notably reduced as compared with the cap-off performance at 25° C. before storing at a low temperature Cap-off Test After Writing The respective marking pens were used for writing in 100 m under an environment of 25° C. Then, the caps were taken off as was the case with the cap-off test described above to compare the writing performances at 25° C. based on a change in a cap-off time with the passage of time with the evaluation results at 25° C. described above and evaluate them according to the following evaluation criteria.

⊙: same as before writing (the cap-off performance at 25° C.)

○: cap-off performance is a little reduced as compared with before writing (the cap-off performance at 25° C.)

×: cap-off performance is notably reduced as compared with before writing (the cap-off performance at 25° C.)

Drawn Line-drying Test

The respective marking pens were used for writing on glass (20×20×0.5 cm) under an environment of 25° C. to determine time passing until the written lines were completely dried by touching with a finger. In the drawn line-drying property, time of 30 seconds or shorter means good (○); time of 10 seconds or shorter means very good (⊙); and time of exceeding 30 seconds means the deteriorated (×) drawn line-drying property.

Overall Evaluation

The cap-off test, the cap-off test after storing at a low temperature, the cap-off test after writing and the drawn line-drying test each described above were taken into overall consideration and evaluated overall according to the following criteria.

Evaluation Criteria

◎: satisfying all items

○: cap-off test after writing is not a little satisfactory, but the other items are satisfied Δ: cap-off test and drawn line-drying test are satisfactory, but the other items are unsatisfactory ×: cap-off test and drawn line-drying test are unsatisfactory

TABLE 2

Cap-off performance evaluation results

| Example | Pen feed kind | Ink kind in Table 1 | Writing performance evaluation based on change in cap-off time with passage of time: 1 hour | 2 hours | 8 hours | 1 day | 3 days | 1 week | 2 weeks | 3 weeks | 1 month | Cap-off test after storing at a low temperature | Cap-off test after writing | Drawn line-drying property | Overall evaluation |
|---|---|---|---|---|---|---|---|---|---|---|---|---|---|---|---|
| 1 | A | Ink (1) | ◎ | ◎ | ◎ | ◎ | ○ | Δ | ▲ | X | X | ◎ | ○ | 5 seconds | ○ |
| 2 | B | Ink (1) | ◎ | ◎ | ◎ | ◎ | ◎ | Δ | ▲ | X | X | ◎ | ○ | 5 seconds | ○ |
| 3 | C | Ink (1) | ◎ | ◎ | ◎ | ○ | Δ | ▲ | X | X | X | ◎ | ○ | 5 seconds | ○ |
| 4 | D | Ink (1) | ◎ | ◎ | ◎ | ◎ | ◎ | ○ | Δ | ▲ | X | ◎ | ○ | 5 seconds | ○ |
| 5 | E | Ink (2) | ◎ | ◎ | ◎ | ◎ | ◎ | ◎ | ◎ | ◎ | ○ | ◎ | ○ | 10 seconds | ○ |
| 6 | F | Ink (1) | ◎ | ◎ | ◎ | ◎ | ○ | Δ | ▲ | X | X | ◎ | ○ | 5 seconds | ○ |
| 7 | G | Ink (1) | ◎ | ◎ | ◎ | ◎ | ◎ | ○ | ▲ | X | X | ◎ | ○ | 5 seconds | ○ |
| 8 | H | Ink (1) | ◎ | ◎ | ◎ | ◎ | ◎ | Δ | ▲ | X | X | ◎ | ○ | 5 seconds | ○ |
| 9 | I | Ink (2) | ◎ | ◎ | ◎ | ◎ | ◎ | ◎ | ◎ | ◎ | ◎ | ◎ | ○ | 10 seconds | ○ |
| 10 | G | Ink (7) | ◎ | ◎ | ◎ | ◎ | ○ | Δ | ▲ | X | X | ◎ | ◎ | 5 seconds | ◎ |
| 11 | H | Ink (7) | ◎ | ◎ | ◎ | ◎ | ◎ | ○ | ▲ | X | X | ◎ | ◎ | 5 seconds | ◎ |
| 12 | I | Ink (7) | ◎ | ◎ | ◎ | ◎ | ◎ | Δ | ▲ | X | X | ◎ | ◎ | 5 seconds | ◎ |
| 13 | G | Ink (8) | ◎ | ◎ | ◎ | ◎ | ◎ | ◎ | ◎ | ◎ | ◎ | ◎ | ◎ | 10 seconds | ◎ |
| 14 | H | Ink (8) | ◎ | ◎ | ◎ | ◎ | ◎ | ◎ | ◎ | ◎ | ◎ | ◎ | ◎ | 10 seconds | ◎ |

Pen feed kind:
A: coating agent (1), treating rate 1% fibrous feed
B: coating agent (1), treating rate 2% fibrous feed
C: coating agent (1), treating rate 3% fibrous feed
D: coating agent (2), treating rate 1% fibrous feed
E: coating agent (3), treating rate 1% fibrous feed
F: coating agent (4), treating rate 1% fibrous feed
G: coating agent (4), treating rate 2% fibrous feed
H: coating agent (4), treating rate 3% fibrous feed
I: coating agent (5), treating rate 2% fibrous feed

TABLE 3

Cap-off performance evaluation results

| Comparative Example | Pen feed kind | Ink kind in Table 1 | Writing performance evaluation based on change in cap-off time with passage of time: 1 hour | 2 hours | 8 hours | 1 day | 3 days | 1 week | 2 weeks | 3 weeks | 1 month | Cap-off test after storing at a low temperature | Cap-off test after writing | Drawn line-drying property | Overall evaluation |
|---|---|---|---|---|---|---|---|---|---|---|---|---|---|---|---|
| 1 | a | Ink (1) | X | X | | | | | | | | ○ | X | 5 seconds | X |
| 2 | a | Ink (3) | ○ | ○ | Δ | ▲ | X | X | | | | X | X | 5 seconds | X |
| 3 | a | Ink (2) | Δ | ▲ | X | X | | | | | | ○ | X | 5 seconds | X |
| 4 | a | Ink (4) | ◎ | ◎ | ○ | ○ | Δ | ▲ | X | X | | X | X | 2 minutes or longer | X |
| 5 | b | Ink (2) | Δ | Δ | X | X | | | | | | ○ | X | 2 minutes or longer | X |
| 6 | a | Ink (5) | ○ | Δ | X | X | | | | | | X | X | 10 seconds | X |
| 7 | a | Ink (6) | ◎ | ◎ | ◎ | ◎ | ◎ | ◎ | Δ | X | X | X | X | 10 seconds | Δ |
| 8 | a | Ink (7) | ◎ | ◎ | ◎ | Δ | X | X | | | | X | X | 5 seconds | Δ |
| 9 | a | Ink (8) | ◎ | ◎ | ◎ | ◎ | ◎ | Δ | X | X | X | X | X | 2 minutes or longer | X |
| 10 | a | Ink (9) | ◎ | ◎ | ◎ | ◎ | Δ | X | X | | | X | X | 5 seconds | Δ |
| 11 | a | Ink (10) | ◎ | ◎ | ◎ | ◎ | ◎ | ◎ | ◎ | ◎ | ◎ | X | X | 10 seconds | Δ |

Pen feed kind:
a: not treated
b: high boiling solvent (benzyl alcohol) dipping-treated, fibrous feed As apparent from the results shown in Table 2 and Table 3 described above, it has been confirmed that the marking pens prepared by coating the pen tips of the present invention obtained in Examples 1 to 14 with the vaporization inhibitors have good writing performances even after exposing the pen tips to the air over a long period of time and show good results on the cap-off test after storing at a low temperature as compared with the marking pens in which the pen tips falling outside the present invention obtained in Comparative Examples 1 to 11 are not coated with the vaporization inhibitors.

To specifically observe the examples, obtained in Examples 1 to 9 are the marking pens prepared by coating the pen tips with the vaporization inhibitors having different melting points, and obtained in Examples 10 to 14 are the writing instruments prepared by coating the pen tips with the coating substances providing the pen tip with a cap-off property and adding the ink additives providing a pen tip with a cap-off property to the inks.

In particular, it has been found that the writing instruments prepared by coating the pen tips with the coating substances providing the pen tip with a cap-off property and adding the ink additives providing the pen tip with a cap-off property to the inks, which were obtained in Examples 10 to 14 are such excellent in a cap-off performance that further better writing performance is obtained even after the pen tips are left standing in the air for long time as compared with the writing instruments obtained in Examples 1 to 9.

In contrast with this, observing Comparative Examples 1 to 11, the pen tips were not coated with the vaporization inhibitors in Comparative Examples 1 and 3, and ordinary components were used for the ink components. It can be found that in these cases, writing was impossible in 2 hours and 8 hours respectively after the caps were taken off.

Further, in Comparative Examples 2 and 4 and Comparative Examples 6 to 11, the vaporization inhibitors were dissolved in the ink components without coating the pen tips with the vaporization inhibitors. It has been found that the cap-off performances were a little improved as compared with those in Comparative Examples 1 and 3, but the performances both in the cap-off tests after storing at a low temperature and after writing were reduced and that the drawn line-drying properties were deteriorated as well in Comparative Examples 4 or 9.

Further, the pen tip which was subjected to conventional high boiling solvent (benzyl alcohol)-dipping treatment was used in Comparative Example 5, and it has been found that the cap-off performance was not good as well in this case and that the performances in the cap-off tests after storing at a low temperature and after writing were reduced and the drawn line-drying property was deteriorated as well.

INDUSTRIAL APPLICABILITY

As described above, the writing instrument according to the present invention has an excellent writing property even after the pen tip is left standing in the air over a long period of time, and it has a stable quality and is excellent in a cap-off performance with the passage of time.

In the writing instruments in which the pen tips are coated with the coating substances having a melting point of 40 to 95° C. and providing the pen tips with a cap-off property, more coating substances providing the pen tips with a cap-off property than required are not eluted in the inks, and therefore a drying time of the drawn lines written on a non-absorbing face of glass is shortened.

Further, in the writing instruments prepared by coating the pen tip with the coating substances providing the pen tip with a cap-off property and adding the ink additives providing the pen tips with a cap-off property to the inks, the cap-off performance is such further excellent that further better writing performance is achieved even after the pen tips are left standing in the air for long time.

What is claimed is:

1. A writing instrument having an excellent cap-off performance, wherein the writing instrument having a pen tip comprising a fibrous feed or a plastic feed, the pen tip described above is coated with a substance which is solid at room temperature and in which a solubility in an ink solvent is 10% or less at room temperature and which repeatedly and constantly films on a surface part of the pen tip that can be broken by writing pressure in writing, among substances providing the pen tip with a cap-off property.

2. The writing instrument having an excellent cap-off performance as described in claim 1, wherein the coated substance has a melting point of 40 to 95° C.

3. The writing instrument having an excellent cap-off performance as described in claim 1, wherein the coating substance is at least one selected from glycerin derivatives, alkylphosphoric acid esters, polyoxyethylenesorbitan fatty acid esters, polyoxyethylenesorbit fatty acid esters, paraffin wax, microcrystalline wax, polyolefin wax, pentaerythritol derivatives and lecithin.

4. The writing instrument having an excellent cap-off performance as described in claim 1, wherein the amount coated on the pen tip is 0.01 to 20% by weight in terms of a weight ratio.

5. The writing instrument having an excellent cap-off performance as described in claim 1, wherein a substance which is solid at room temperature and in which a solubility in an ink solvent is 0.01 to 10% at room temperature among the substances providing a cap-off property is added to an ink in the writing instrument and the adding amount of which is 0.01 to 10% by weight based on total amount of the ink.

6. The writing instrument having an excellent cap-off performance as described in claim 5, wherein the substance providing a cap-off property which is added to the ink is at least one selected from glycerin derivatives, alkylphosphoric acid esters, polyoxyethylenesorbitan fatty acid esters, polyoxyethylenesorbit fatty acid esters, paraffin wax, microcrystalline wax, polyolefin wax, pentaerythritol derivatives and lecithin.

7. The writing instrument having an excellent cap-off performance as described in claim 1, being a direct liquid writing instrument comprising an ink tank part which is a barrel for directly storing an ink and a collector member for temporarily reserving the ink, wherein the ink is derived from the ink tank part to the pen tip directly or via a feed.

8. The writing instrument having an excellent cap-off performance as described in claim 1, being a writing instrument having an ink reservoir absorbing an ink in a barrel, wherein the ink is derived from the ink reservoir to the pen tip directly or via feed.

* * * * *